US009249651B2

(12) United States Patent
Baker et al.

(10) Patent No.: US 9,249,651 B2
(45) Date of Patent: Feb. 2, 2016

(54) METHOD AND APPARATUS FOR DOWNHOLE APPLICATION OF TREATMENT CHEMICALS IN GAS WELLS

(71) Applicant: Jacam Chemical Company 2013, LLC, Sterling, KS (US)

(72) Inventors: James C. Baker, Anthony, KS (US); Harlan G. McCormack, Wichita, KS (US); Gene F. Brock, Conroe, TX (US); Gene H. Zaid, Sterling, KS (US)

(73) Assignee: Jacam Chemical Company 2013, LLC, Sterling, KS (US)

( * ) Notice: Subject to any disclaimer, the term of this patent is extended or adjusted under 35 U.S.C. 154(b) by 255 days.

(21) Appl. No.: 13/903,986

(22) Filed: May 28, 2013

(65) Prior Publication Data

US 2014/0352965 A1 Dec. 4, 2014

(51) Int. Cl.

| | |
|---|---|
| ***E21B 19/084*** | (2006.01) |
| ***E21B 43/10*** | (2006.01) |
| ***E21B 41/02*** | (2006.01) |
| ***E21B 33/126*** | (2006.01) |

(52) U.S. Cl.

CPC ..... *E21B 41/02* (2013.01); *E21B 33/126* (2013.01)

(58) Field of Classification Search

CPC ..... E21B 43/168; E21B 43/121; E21B 43/10; E21B 19/084

USPC ..... 166/300

See application file for complete search history.

(56) References Cited

U.S. PATENT DOCUMENTS

| | | | | |
|---|---|---|---|---|
| 4,018,185 | A | | 4/1977 | Myers |
| 4,483,888 | A | * | 11/1984 | Wu ..... 427/336 |
| 4,638,726 | A | | 1/1987 | Johnson et al. |
| 5,119,874 | A | | 6/1992 | Ferguson et al. |
| 5,884,700 | A | * | 3/1999 | Cook et al. ..... 166/153 |
| 5,936,059 | A | | 8/1999 | Zaid |
| 5,945,164 | A | | 8/1999 | Zaid |
| 7,407,687 | B2 | | 8/2008 | Zaid et al. |

OTHER PUBLICATIONS

Martin, Richard L. "Corrosion Inhibitors for Oil and Gas Production." ASM Handbook, vol. 13A: Corrosion: Fundamentals, Testing, and Protection, pp. 878-886. 2003.

* cited by examiner

*Primary Examiner* — Zakiya W Bates
*Assistant Examiner* — Ashish Varma
(74) *Attorney, Agent, or Firm* — Hovey Williams LLP

(57) ABSTRACT

Improved methods are provided for the application of downhole oil or gas well treating agents, such as liquid corrosion inhibition agents. The methods involve first lowering a liquid retainer device into a well casing, preferably at or above the location of the well production zone, followed by introduction of a liquid treating agent. The presence of the liquid retainer device prevents substantial passage of the agent into the production zone, and forms a column of the liquid agent above the device. The retainer device is then withdrawn from the well so as to create a substantially uniform film of the agent along the inner surfaces of the well casing. In this manner, proper coating of the casing is achieved while preventing production losses owing to passage of the treating agent into the production zone. The liquid retainer is preferably one or more swab cups or oil field retainers.

19 Claims, 1 Drawing Sheet

METHOD AND APPARATUS FOR DOWNHOLE APPLICATION OF TREATMENT CHEMICALS IN GAS WELLS

BACKGROUND OF THE INVENTION

1. Field of the Invention

The present invention is concerned with methods for application of liquid treating agents to the inner surfaces of well casings. More particularly, the invention is concerned with such methods which substantially inhibit or prevent passage of the treating agents into the well production zones, while at the same time creating a substantially uniform film of treating agent on the inner casing surfaces. The invention is particularly suited for application of film-type corrosion inhibitors to the inside surfaces of well casings.

2. Description of the Prior Art

During the production of oil and gas, water (or brine) is typically produced as an undesirable byproduct. When brine is generated in the presence of carbon dioxide, carbonic acid species may occur in solution resulting in greater water production and increased corrosion problems. In order to prevent failures due to corrosive metal losses, corrosion-inhibiting chemicals are frequently introduced into producing or injecting wells.

There are several methods for applying corrosion-inhibiting chemicals to protect downhole metal goods. The corrosion inhibitor may be supplied as a free-flowing liquid, as water or oil external emulsions, or as solids Inhibiting chemicals may be applied intermittently or continuously into a given well. In continuous applications, a liquid inhibitor is injected into the well casing. In many batch applications, corrosion inhibitor is injected and flows down the casing followed by a liquid flush.

A problem often encountered in application of corrosion inhibitors is that the inhibitors may adversely affect well production. It is believed that this problem stems from the tendency of corrosion inhibitors to flow into the production zone of the well and adhere to the production structure, particularly in the case of film-forming inhibitors.

There is accordingly a need in the art for an improved method of well treating agents such as corrosion inhibitors into producing wells, without the attendant problem of retarding oil or gas production.

SUMMARY OF THE INVENTION

The present invention overcomes the problems outlined above, and provides methods for applying liquid treating agents into producing oil or gas wells, the latter having a tubular casing within the well bore and a below-grade oil or gas production zone. The method comprises the steps of first lowering a liquid retainer device into the casing, preferably to a level at or above the production zone, followed by introducing a desired liquid treating agent into the casing. The treating agent may be allowed to gravitate to the level of the liquid retainer device, or water can be injected to force the treating agent downwardly. In any case, the liquid retainer device operates to prevent substantial flow of the treating agent past and below the device so that the treating agent forms a liquid column above the device. In instances where flush water is used, the latter forms a column atop the treating agent column within the casing. Next, the liquid retainer device is elevated to the surface, which serves to essentially completely coat the inner surface of the casing with the treating agent. At the same time, the agent is not permitted to flow downwardly to any substantial degree below the retainer device, and is simply recovered at the surface.

Typically, the liquid retainer device is secured to an elongated wire lead, which is dropped downwardly into the well casing to the required depth. The lead may be equipped with a pair of retainer devices and a weight to assist in lowering the entire assembly. The liquid retainer device may be any structure which adequately retains the liquid and assists in coating the casing during elevation thereof. For example, use may be made of conventional swab cups used in the oil field industry to remove liquid and debris from wells. Such exemplary swab cups are illustrated in U.S. Pat. Nos. 4,018,185, 4,638,726, and 5,119,874, and in a three-page article entitled *Swab Cup Examples*, illustrating types GW, NUF, TA, MV, UF, TA, J, and TUF cups. An alternate type of liquid retainer device is a well retainer, also used in the past for clearing debris and liquid from well bores.

Virtually any film-forming liquid corrosion inhibitor can be applied using the methods of the invention. Such inhibitors may be produced using fatty acids and some form of basic nitrogen-containing precursor. However, the inhibitors currently in use are generally more complex and are formulated to meet specific customer needs. Particularly preferred corrosion inhibitors are commercialized by Jacam Chemicals, LLC of Sterling, Kans. under the trademark "SUPERCORR®." These inhibitors generally include an epoxy resin dispersed in a first aromatic hydrocarbon dispersant, and an epoxy curing agent in a second aromatic hydrocarbon dispersant and selected from the group consisting of the alkoxylated amines, the imidazolines, and mixtures thereof. The epoxy resin of the preferred product comprises glycidyl ethers prepared by the reaction of epichlorihydrin with bisphenol A, whereas the curing agent comprises an alkoxylated tallow amine. These inhibitors are fully described in U.S. Pat. Nos. 5,936,059 and 5,945,164, both incorporated by reference herein in their entireties.

The components of the SUPERCORR® product may be mixed together and introduced (e.g., injected) as a complete system into a casing. Alternately, the components may be sequentially introduced. The latter method is fully described in U.S. Pat. No. 7,407,687, also incorporated herein in its entirety.

Although the invention is chiefly intended for the application of liquid corrosion inhibitors, the techniques of the invention may be used for application of any liquid film-forming treating agent into producing oil or gas wells, e.g., surfactants.

DETAILED DESCRIPTION OF THE PREFERRED EMBODIMENT

Figure 1:
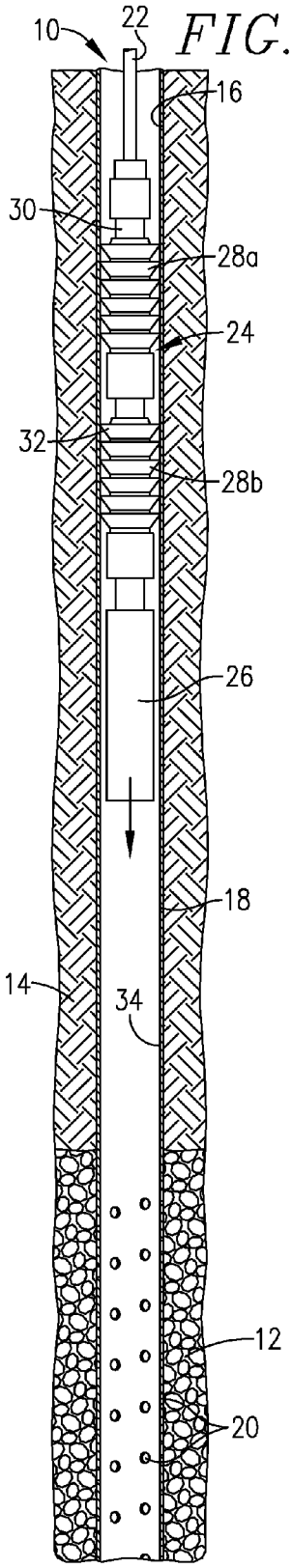
FIG. 1 is a fragmentary schematic representation illustrating the first step in the preferred method of the invention, wherein a lead supporting a liquid retainer device is lowered into a well bore casing.

Turning to the drawing, the present invention is designed for the treatment of a producing oil or gas well 10 having a below-grade production zone 12 with overburden soil 14 over the zone 12. The well includes a bore 16 with an elongated, multiple-section steel casing 18 extending along the length of the bore down to the production zone 12. Apertures 20 are provided in the casing 18 at the zone 12, in order to permit oil or gas to enter the casing for recovery using conventional sucker rod/pump equipment (not shown).

In most wells of this type, corrosion inhibition and/or other treating agents need to be applied to the inner surfaces of the casing 18 in order to retard loss of metal due to corrosion and ultimate failure of the casing. In accordance with the present invention, an elongated wire-like lead 22 is prepared having, adjacent the lower end thereof, at least one, and preferably two, liquid retainer devices 24, and optionally a lowermost weight 26. In the illustrated embodiment, the liquid retainer device comprises a pair of end-to-end aligned type MV swab cups 28*a*, 28*b*. As illustrated, the swab cups 28*a*, 28*b* include a central shaft 30 and a series of upwardly facing, vertically spaced, outwardly flared skirts 32. The cups 28*a*, 28*b* are dimensioned so as to at least slightly engage the inner surfaces 34 of the casing 18, while still permitting up and down movement of the liquid retainer device 24 within the confines of the casing 18.

Figure 2:
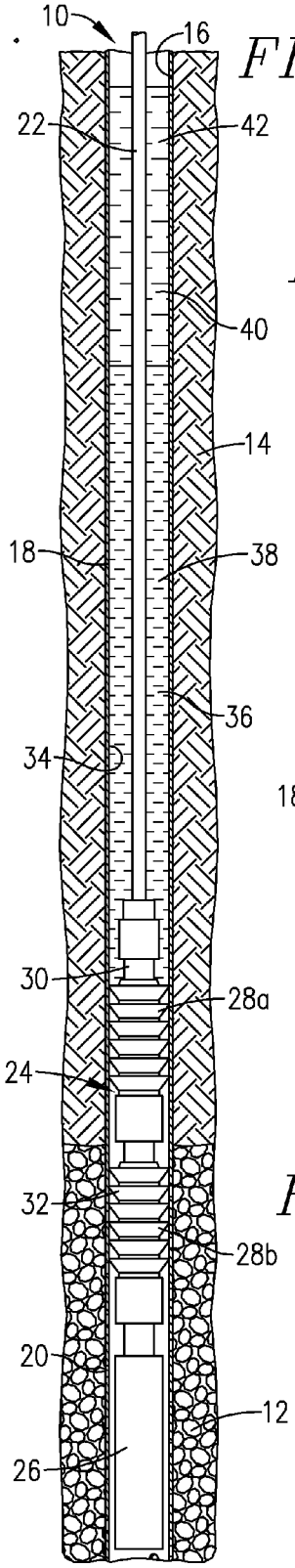
FIG. 2 is a view similar to that of FIG. 1, but illustrating application of a column of liquid well-treating agent above the liquid retainer device, and with a column of water atop the column of agent.
Figure 3:
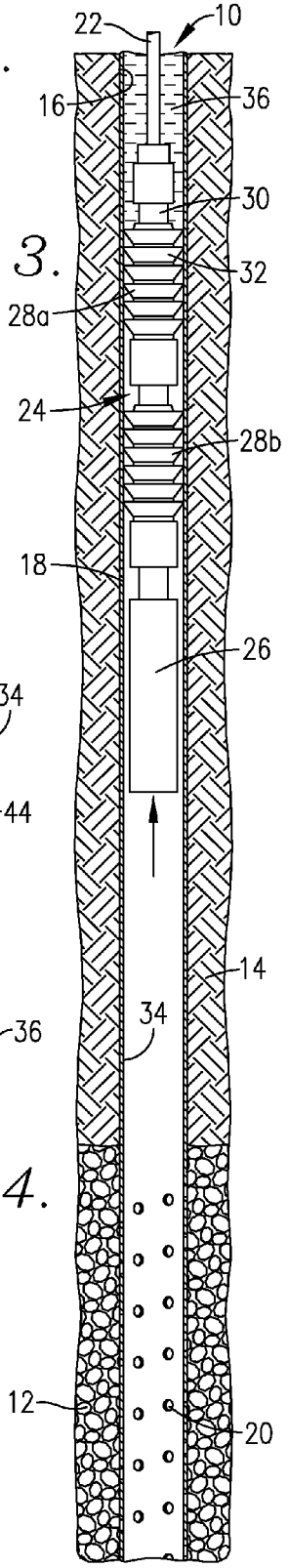
FIG. 3 is a view similar to that of FIGS. 1-2, but illustrating the step of lifting the lead and liquid retainer device in order to coat the interior surface of the casing with the treating agent, while also elevating the columns of agent and water to prevent undue loss of the treating agent into the production zone of the well.
Figure 4:
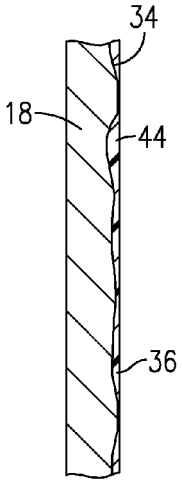
FIG. 4 is an enlarged, fragmentary view illustrating application of a film-forming corrosion-inhibition agent to the inner surface of a well bore casing, using the methods of the invention.

In the first step of the method of the invention, the lead 22 is lowered into the casing 18, as depicted in FIG. 1. Normally, the casing is substantially free of oil, water, and debris at this stage, but some water and oil can be present in the casing. The lead 22 is lowered until the liquid retainer device 24 is positioned at or slightly above the upper extend of the formation 12, as illustrated in FIG. 2. Once the device 24 is properly positioned, a liquid treating agent 36 is poured, injected, or otherwise introduced into the casing and allowed to descend to the level of the device 24. This creates an elongated column 38 of the treating agent extending above the device 24. Optionally, water 40 may be injected after the treating agent to assist forcing the latter downwardly; this water thus forms a second column 42 above the treating agent column 38.

In the final step of the method, the lead 22 is withdrawn from the casing 18 so that the device 24 moves upwardly with the outer periphery thereof engaging the inner surfaces 34 of the casing 18. This in turn serves to substantially evenly and completely coat the surfaces 34 until the device 24 reaches the surface. As this occurs, any residual treating agent is collected for re-use. Thus, at the conclusion of the method, the inner surfaces 34 have a more or less even film 44 of the treating agent 36 thereon.

By virtue of the use of the retainer device 24, very little if any of the treating agent 36 is allowed to descend to the level of the production zone 12. Hence, the problem heretofore encountered when liquid treating agent flows into the production zone is substantially eliminated.

The above method is particularly suited for the application of the previously described SUPERCORR® corrosion inhibitor, when the components thereof are premixed and introduced as a complete composition. In certain instances, though, it may be desirable to sequentially introduce the components of the SUPERCORR® system. For example, it may be desired to first apply the epoxy resin component. This is done in exactly described above, using the liquid retainer 24 to ensure that the resin does not flow into the production zone 12. After this initial injection of resin, it may be desirable to apply a liquid different than the components of the SUPERCORR® system, e.g., a fluid selected from the group consisting of oil, natural gas, process water, and mixtures thereof. Thereafter, the curing agent component of the system is applied to complete the well treatment. The sequential application of SUPERCORR® components could also be reversed, i.e., the curing agent may be applied first, followed by the epoxy resin. These techniques are fully described in the aforementioned U.S. Pat. No. 7,407,687.

Other types of liquid retainer devices can be used in lieu of the depicted swab cups. For example, other swab cup configurations known in the art can also be employed. Moreover, known oil well bailer devices may also be used. Basically, any type of device capable of substantially retaining the liquids as applied during the method may be used in the context of the invention.

The methods of the invention also reduce amount of waste associated with well treatment. That is, the necessary treatment volumes of the corrosion inhibitor or other liquid agent can be calculated based upon the total area of the casing surfaces to be coated. In this manner, only enough of the relatively expensive treatment agents may be used, while still achieving an adequate film coating.

We claim:

1. A method of applying a liquid treating agent into a producing oil or gas well, said well having a tubular casing within the well bore and a below-grade oil or gas production zone, said method comprising the steps of:

first lowering a liquid retainer device into said casing, said device having an uppermost end;

after said device-lowering step, introducing said liquid treating agent into said casing from a point above the uppermost end of the retainer device and with said retainer device present within the casing, said liquid retainer device preventing substantial flow of the treating agent below the liquid retainer device, so that the liquid treating agent is in a liquid column above the liquid retainer device; and elevating said liquid retainer device and said column of liquid treating agent to the surface and, during the elevating step, causing the liquid treating agent to coat the inner surfaces of said casing.

2. The method of claim 1, including the step of lowering said liquid retainer device to a point substantially adjacent to or above said production zone.

3. The method of claim 1, including the step of introducing water into said casing after said introduction of said liquid treating agent so that the water forms a column above the column of liquid treating agent.

4. The method of claim 1, said liquid retainer device operably coupled to an elongated lead line, said lowering step comprising the step of lowering said lead line with the coupled liquid retainer device, and said elevating step comprising the step of elevating said lead line and coupled liquid retainer device to the surface.

5. The method of claim 4, said liquid retainer device selected from the group consisting of a swab cup, an oil well bailer, or combinations thereof.

6. The method of claim 5, said liquid retainer device being first and second swab cups supported by said lead line.

7. The method of claim 4, including a weight supported by the lead line to facilitate lowering of the lead line into the well casing.

8. The method of claim 1, said introducing step comprising the step of introducing a complete well treating agent into said casing.

9. The method of claim 1, said introducing step comprising the steps of sequentially introducing components of said well treating agent into said casing.

10. The method of claim 1, said treating agent selected from the group consisting of corrosion inhibitors, surfactants, and mixtures thereof.

11. The method of claim 10, said treating agent comprising a film-forming corrosion inhibitor.

12. The method of claim 11, said corrosion inhibitor an epoxy resin in a first aromatic hydrocarbon dispersant, and a curing agent for the epoxy resin in a second aromatic hydrocarbon dispersant.

13. The method of claim 12, said curing agent selected from the group consisting of alkoxylated amines and the imidazolines, and mixtures thereof.

14. The method of claim 13, said epoxy resin comprising glycidyl ethers prepared by the reaction of epichlorihydrin with bisphenol A, said curing agent comprising an alkoxylated tallow amine.

15. The method of claim 12, said epoxy resin and curing agent being mixed together and introduced into said casing.

16. The method of claim 12, including the steps of first introducing one of said epoxy resin and said curing agent, and subsequently introducing the other of said epoxy resin and curing agent.

17. The method of claim 16, including the step of first introducing said epoxy resin into said casing, and subsequently introducing said curing agent into said casing.

18. The method of claim 16, including the step of introducing a fluid separate from said epoxy resin and said curing agent into said casing after said first introducing step, said separate fluid selected from the group consisting of oil, natural gas, process water, and mixtures thereof.

19. The method of claim 1, said retainer device supported by an elongated lead, said first lowering step comprising the step of lowering the lead with the retainer into said casing.

* * * * *